US009445487B2

(12) United States Patent
Kosugi et al.

(10) Patent No.: US 9,445,487 B2
(45) Date of Patent: Sep. 13, 2016

(54) X-RAY IRRADIATION DEVICE AND X-RAY RADIATION SOURCE

(71) Applicant: HAMAMATSU PHOTONICS K.K., Hamamatsu-shi, Shizuoka (JP)

(72) Inventors: Norimasa Kosugi, Hamamatsu (JP); Naoki Okumura, Hamamatsu (JP); Tatsuya Nakamura, Hamamatsu (JP); Toru Fujita, Hamamatsu (JP); Tomoyuki Okada, Hamamatsu (JP); Akiomi Ujima, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 91 days.

(21) Appl. No.: 14/378,723

(22) PCT Filed: Feb. 7, 2013

(86) PCT No.: PCT/JP2013/052897

§ 371 (c)(1),
(2) Date: Aug. 14, 2014

(87) PCT Pub. No.: WO2013/129067

PCT Pub. Date: Sep. 6, 2013

(65) Prior Publication Data

US 2015/0030131 A1 Jan. 29, 2015

(30) Foreign Application Priority Data

Mar. 2, 2012 (JP) ..... 2012-046850

(51) Int. Cl.
*H05G 1/02* (2006.01)
*H05G 1/70* (2006.01)

(Continued)

(52) U.S. Cl.
CPC ..... *H05G 1/70* (2013.01); *H05G 1/02* (2013.01); *H05G 1/085* (2013.01); *H05G 1/10* (2013.01); *H05G 1/54* (2013.01)

(58) Field of Classification Search
CPC ..... A61B 6/4007; A61B 6/4014
See application file for complete search history.

(56) References Cited

U.S. PATENT DOCUMENTS 8,299,719 B1 * 10/2012 Moshirnoroozi .. H05B 33/0806 315/185 R
2010/0245682 A1 9/2010 Takata

FOREIGN PATENT DOCUMENTS

CN 1589737 3/2005
CN 2834102 11/2006

(Continued)

OTHER PUBLICATIONS

English-language translation of International Preliminary Report on Patentability (IPRP) dated Sep. 12, 2014 that issued in WO Patent Application No. PCT/JP2013/052897.

*Primary Examiner* — Hoon Song
(74) *Attorney, Agent, or Firm* — Drinker Biddle & Reath LLP

(57) ABSTRACT

An X-ray radiation device comprises a plurality of X-ray radiation units, each having an X-ray tube for generating an X-ray, a drive circuit for driving the X-ray tube, and a trunk line connected to the drive circuit, and a controller having a control circuit for controlling the X-ray radiation units. The trunk lines of the plurality of X-ray radiation units are connected in series to the control circuit so that the drive circuits of the plurality of X-ray radiation units are connected in parallel to the control circuit. Since the trunk lines of the plurality of X-ray radiation units are connected in series to the control circuit, the X-ray radiation units can be connected to each other and are not required to be connected one by one to the controller. This makes it possible to increase and decrease the number of units without complicating their wiring.

14 Claims, 16 Drawing Sheets

(51) Int. Cl.

| | |
|---|---|
| ***H05G 1/08*** | (2006.01) |
| ***H05G 1/10*** | (2006.01) |
| ***H05G 1/54*** | (2006.01) |

(56) References Cited

FOREIGN PATENT DOCUMENTS

| | | | |
|---|---|---|---|
| GB | 2 022 980 | A | 12/1979 |
| JP | S55/4882 | A | 1/1980 |
| JP | H09-24110 | A | 1/1997 |
| JP | 2004-357724 | A | 12/2004 |
| JP | 2006-066075 | A | 3/2006 |
| JP | 2006-338965 | A | 12/2006 |
| JP | 2008-299275 | A | 12/2008 |
| JP | 2009-503778 | A | 1/2009 |

* cited by examiner

X-RAY IRRADIATION DEVICE AND X-RAY RADIATION SOURCE

TECHNICAL FIELD

The present invention relates to an X-ray radiation device and an X-ray radiation source.

BACKGROUND ART

An X-ray radiation device equipped with a plurality of X-ray radiation units (X-ray radiation sources) having X-ray tubes have conventionally been disclosed (see, for example, Patent Literature 1). For example, such an X-ray radiation device has been in use as an electrostatic remover which irradiates a gas such as air with X-rays, so as to generate an ion gas, thereby removing electricity of an object. The X-ray radiation device as an electrostatic remover has been employed in wide fields such as manufacturing of IC (integrated circuits), LCD (liquid crystal displays), and PDP (plasma display panels).

An X-ray radiation device in which a plurality of X-ray radiation units are attached at fixed intervals to a support member such as a curtain rail, so that each of the X-ray radiation units emits X-rays, has also been disclosed (see, for example, Patent Literature 2). By changing the length of the support member or the number of X-ray radiation units, the X-ray radiation device described in Patent Literature 2 can freely adjust its X-ray radiation range according to the size and form of the object for electrostatic removal.

CITATION LIST

Patent Literature

Patent Literature 1: Japanese Patent Application Laid-Open No. 2006-338965
Patent Literature 2: Japanese Patent Application Laid-Open No. 2006-66075

SUMMARY OF INVENTION

Technical Problem

For using an X-ray radiation device such as the one mentioned above as an electrostatic remover, it is necessary for each of the X-ray radiation units to be connected to a controller for controlling them. However, simply connecting each X-ray radiation unit to the controller with a relay cable may complicate the wiring of relay cables extending from the controller, thereby worsening the workability in setting the device such as increasing and decreasing the number of units.

For solving the problem mentioned above, it is an object of the present invention to provide an X-ray radiation device and X-ray radiation source which can increase and decrease the number of X-ray radiation sources without complicating the wiring.

Solution to Problem

The X-ray radiation device in accordance with the present invention is an X-ray radiation device comprising a plurality of X-ray radiation sources, each having an X-ray tube for generating an X-ray, a drive circuit for driving the X-ray tube, and a trunk line connected to the drive circuit, and a controller having a control circuit for controlling the X-ray radiation sources, the trunk lines of the plurality of X-ray radiation sources being connected in series to the control circuit so that the drive circuits of the plurality of X-ray radiation sources are connected in parallel to the control circuit.

By connecting a plurality of trunk lines in parallel to the control circuit, such an X-ray radiation device can connect a plurality of drive circuits in parallel to the control circuit and enables the controller to control all the X-ray radiation sources connected. Since the plurality of trunk lines are connected in series to the control circuit, the X-ray radiation sources can be connected to each other and are not required to be connected one by one to the controller. This makes it possible to increase and decrease the number of X-ray radiation sources without complicating the wiring.

Preferably, the X-ray radiation source further comprises input and output terminals serving as external connection ports for the trunk line, while the output terminal of one X-ray radiation source is detachably connected to the input terminal of another X-ray radiation source through a relay cable. This makes it easier to increase and decrease the number of X-ray radiation sources.

Preferably, the X-ray radiation device further comprises a rail for attaching thereto a plurality of X-ray radiation sources in a row; the X-ray radiation source further comprises a housing for containing the X-ray tube, drive circuit, trunk line, input terminal, and output terminal; the housing has on the outside thereof an X-ray emission surface for emitting the X-ray generated by the X-ray tube, a back face opposing the X-ray emission surface, and a pair of side faces intersecting the X-ray emission surface while opposing each other; the input and output terminals are arranged so as to open respectively at the pair of side faces; and each of the X-ray radiation sources is attached to the rail such that the back face opposes the rail while the opposing direction of the pair of side faces lies along the extending direction of the rail.

In this case, the input and output terminals open at the side faces of the housing intersecting the X-ray emission surface of the housing, thereby making it harder for the relay cable connected to the input and output terminals to extend in the X-ray emission direction. This can prevent the relay cable from obstructing the X-ray emission. Since the opposing direction of the pair of side faces lies along the extending direction of the rail, the input and output terminals of the X-ray radiation sources adjacent to each other oppose each other. This arranges the X-ray radiation sources and relay cables alternately along the extending direction of the rail, thereby making it easier to increase and decrease the number of X-ray radiation sources, and can restrain the X-ray radiation device from widening in the width direction of the rail, so as to save space.

Preferably, the rail and housing are made of a metal material, the housing is attached to the rail through a joint member detachably attached to the rail, and the joint member is made of an insulating material. In this case, the rail is made of a metal material and thus secures its strength. The housing is made of a metal material and thus constructs a shield against physical shocks, electromagnetic wave noise, and the like which may affect the X-ray radiation source. The X-ray radiation sources are attached to the rail through the joint members detachably attached to the rail and thus can easily increase and decrease their number. While external noise may transfer to the rail made of a metal and further to the housing, the joint members made of an insulating material block the electric connection between the rail and the housing, thereby preventing the electric noise from transferring from the rail to the housing. This enables the X-ray radiation sources to operate stably.

Preferably, the X-ray radiation device further comprises a joint member for holding the relay cable near the rail. In this case, even when the number of X-ray radiation sources is increased, the same joint member as that interposed between the housing and the rail can be utilized for holding the relay cable near the rail, so as to prevent the relay cable more reliably from obstructing the X-ray emission, thereby making it easier to increase and decrease the number of X-ray radiation sources.

Preferably, the control circuit has a power circuit for supplying power to the drive circuit, a control signal transmission circuit for transmitting a control signal for driving and stopping the X-ray tubes, and a life notification signal receiving circuit for receiving a life notification signal concerning a life of the X-ray tubes; the trunk line has a power line for transmitting power to the drive circuits, a control signal line for transmitting the control signal, and a life notification signal line for transmitting the life notification signal; and the drive circuit has a drive control circuit for receiving the control signal from the control signal line and controlling the driving and stopping of the X-ray tubes, and a life detection circuit for detecting the life of the X-ray tubes and transmitting the life notification signal to the life notification signal line.

This enables the power circuit to supply power to the individual drive circuits through the respective power lines at the same time. The control signal transmission circuit can transmit the control signals to the individual drive control circuits through the respective control signal lines at the same time, so as to control the driving or stopping of the X-ray tubes simultaneously. When any of the life detection circuits detects the life of the X-ray tube and transmits the life notification signal, the life notification signal can be received by the life notification signal receiving circuit through the life notification signal line. This makes it easier to increase and decrease the number of X-ray radiation sources.

Preferably, the life detection circuit has a comparator circuit for comparing a drive current value of the X-ray tubes with a preset threshold and detects the life of the X-ray tubes according to a result of comparison in the comparator circuit. Preferably, the life detection circuit has a comparator circuit for comparing a drive voltage value of the X-ray tubes with a preset threshold and detects the life of the X-ray tubes according to a result of comparison in the comparator circuit. This can clearly detect the life of the X-ray tubes according to a uniform reference.

Preferably, the drive circuit further comprises a display circuit for externally displaying the transmission of the life notification signal. This can report from which X-ray radiation source the life notification signal is transmitted.

Preferably, the display circuit has a light-emitting device for emitting light according to the life notification signal and a capacitor connected in parallel to the light-emitting device. In this case, even after the life notification signal disappears, the light-emitting device emits light due to the electric charge accumulated in the capacitor. Therefore, even after the power of the whole X-ray radiation device is turned off in order to exchange the X-ray radiation sources, it can be reported from which X-ray radiation source the life notification signal is transmitted.

The X-ray radiation source in accordance with the present invention is an X-ray radiation source comprising an X-ray tube for generating an X-ray, a drive circuit for driving the X-ray tube, a trunk line connected to the drive circuit, and input and output terminals serving as external connection ports for the trunk line, while a voltage value inputted from the input terminal is equal to that outputted from the output terminal.

Even when the output terminal of one X-ray radiation source is connected to the input terminal of another X-ray radiation source, so that a plurality of X-ray radiation sources are connected in a row, the same voltage value can be supplied to all the X-ray radiation sources. Therefore, the X-ray radiation sources can be connected to each other and are not required to be connected one by one to a power supply. This makes it possible to increase and decrease the number of X-ray radiation sources without complicating the wiring.

Preferably, the X-ray radiation source further comprises a housing for containing the X-ray tube, drive circuit, trunk line, input terminal, and output terminal; the housing has on the outside thereof an X-ray emission surface for emitting the X-ray generated by the X-ray tube, a back face opposing the X-ray emission surface, and a pair of side faces intersecting the X-ray emission surface while opposing each other; and the input and output terminals are arranged so as to open respectively at the pair of side faces.

In this case, the input and output terminals open at the side faces of the housing intersecting the X-ray emission surface of the housing, thereby making it harder for a relay cable, if any, connecting the output terminal of one X-ray radiation source to the input terminal of another X-ray radiation source to extend in the X-ray emission direction. This can prevent the relay cable from obstructing the X-ray emission. Since the input and output terminals open at a pair of side faces opposing each other, alternately arranging the X-ray radiation sources and relay cables so as to construct the X-ray radiation device makes it easy to increase and decrease the number of X-ray radiation sources and can prevent the relay cables from widening in the width direction of the row of the X-ray radiation sources, so as to save space.

Preferably, the trunk line has a power line for transmitting power to the drive circuit, a control signal line for transmitting a control signal for driving and stopping the X-ray tube, and a life notification signal line for transmitting a life notification signal concerning a life of the X-ray tube; and the drive circuit has a drive control circuit for receiving the control signal from the control signal line and controlling the driving and stopping of the X-ray tube, and a life detection circuit for detecting the life of the X-ray tube and transmitting the life notification signal to the life notification signal line.

When trunk lines of a plurality of X-ray radiation sources are connected in series in this case, power can be supplied to the individual drive circuits at the same time through the respective power lines. The control signals can be transmitted to the individual drive control circuits at the same time through the respective control signal lines, so as to control the driving or stopping of the X-ray tubes simultaneously. When any of the life detection circuits detects the life of the X-ray tube and transmits the life notification signal, the life notification signal can be received by the life notification signal receiving circuit through the life notification signal line. This makes it easier to increase and decrease the number of X-ray radiation sources.

Preferably, the life detection circuit has a comparator circuit for comparing a drive current value of the X-ray tube with a preset threshold and detects the life of the X-ray tube according to a result of comparison in the comparator circuit. Preferably, the life detection circuit has a comparator circuit for comparing a drive voltage value of the X-ray tube with a preset threshold and detects the life of the X-ray tubes according to a result of comparison in the comparator circuit. This can clearly detect the life of the X-ray tube according to a uniform reference.

Preferably, the drive circuit further comprises a display circuit for externally displaying the transmission of the life notification signal. This can report from which X-ray radiation source the life notification signal is transmitted.

Preferably, the display circuit has a light-emitting device for emitting light according to the life notification signal and a capacitor connected in parallel to the light-emitting device. In this case, even after the life notification signal disappears, the light-emitting device emits light due to the electric charge accumulated in the capacitor. Therefore, even after the power of the whole X-ray radiation device is turned off in order to exchange the X-ray radiation sources, it can be reported from which X-ray radiation source the life notification signal is transmitted.

Advantageous Effects of Invention

The present invention can provide an X-ray radiation device and X-ray radiation source which can increase and decrease the number of X-ray radiation sources without complicating the wiring.

DESCRIPTION OF EMBODIMENTS

Figure 1:
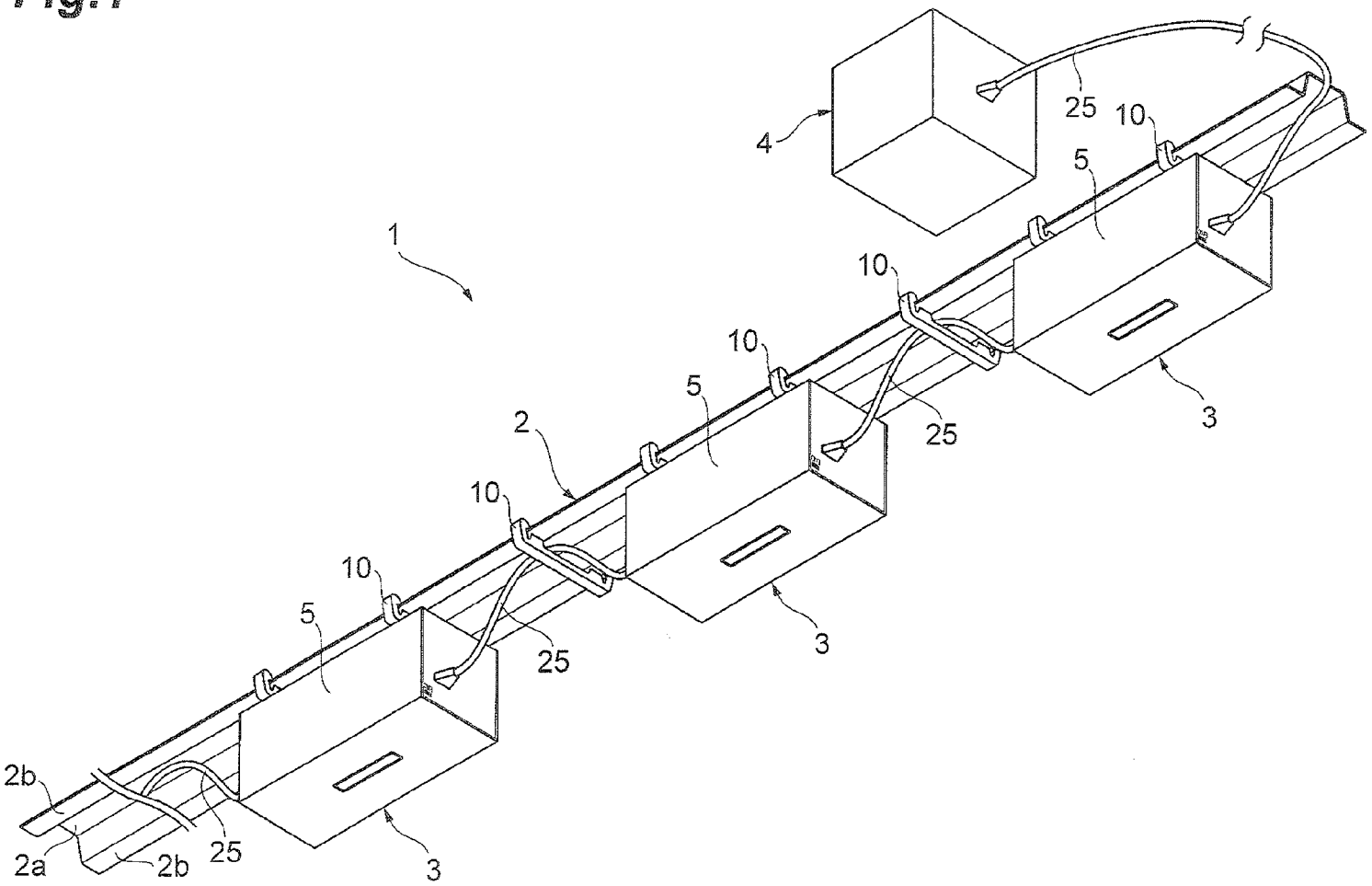
FIG. 1 is a perspective view illustrating an embodiment of an X-ray radiation device including X-ray radiation units (X-ray radiation sources) in accordance with the present invention.

In the following, preferred embodiments of the X-ray radiation source and X-ray radiation device in accordance with the present invention will be explained in detail with reference to the drawings. FIG. 1 is a perspective view illustrating an embodiment of the X-ray radiation device including X-ray radiation units (X-ray radiation sources) in accordance with the present invention. The depicted X-ray radiation device 1 is constructed, for example, as a photoionizer (photoirradiation-type electrostatic remover) which is placed in a clean room or the like in a production line handling a large glass sheet or the like and removes electricity of the large glass sheet or the like by irradiation with X-rays.

This X-ray radiation device 1 comprises a plurality of X-ray radiation units (X-ray radiation sources) 3 for emitting X-rays, a controller 4 for controlling the X-ray radiation units 3, and a rail member 2 for holding the X-ray radiation units 3 in a row. The rail member 2 has a channel part 2*a* having a substantially U-shaped cross section and flange parts 2*b*, 2*b* projecting laterally from both end portions in the width direction of the channel part 2*a*. The rail member 2 is formed from a metal, for example, and secures a strength sufficient for holding the plurality of X-ray radiation sources 3. The plurality of X-ray radiation units 3 are arranged at desirable intervals, e.g., equally spaced intervals, along the longitudinal direction of the rail member 2. Objects for electrostatic removal are arranged on an X-ray emission surface M1 (which will be explained later) side of the X-ray radiation units 3. The length of the rail member 2, the number and intervals of X-ray radiation units 3, and the like are changed as appropriate according to the size, number, and form of objects.

Figure 2:
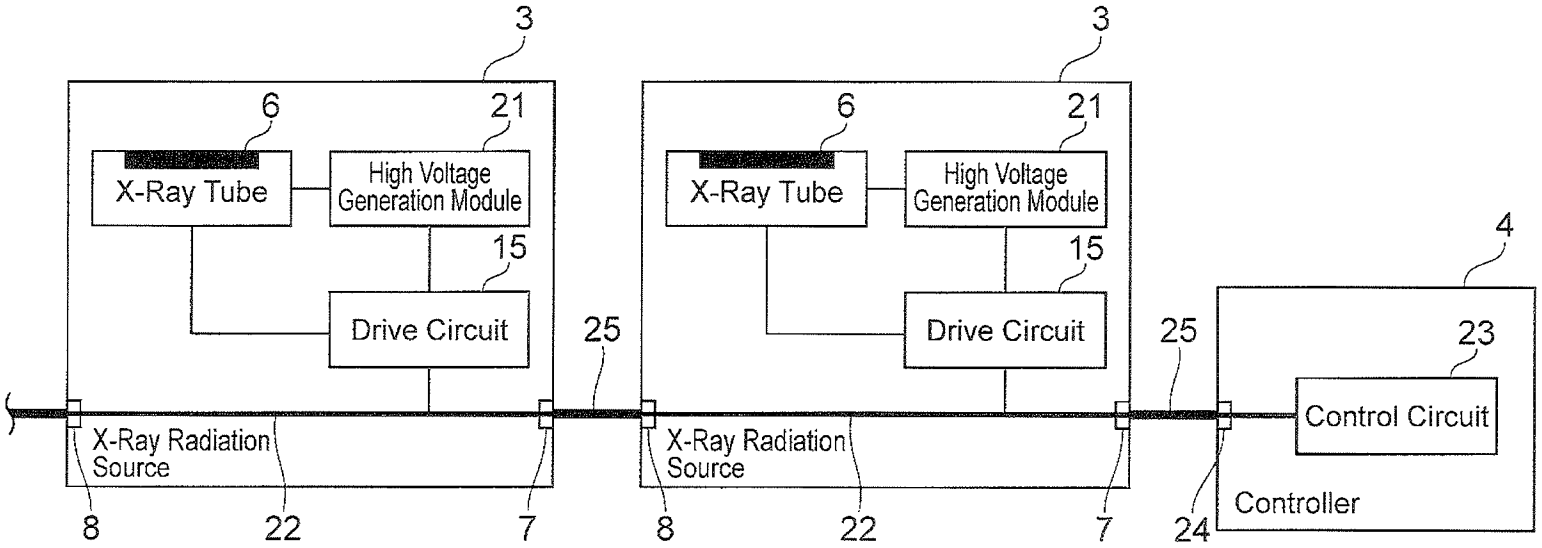
FIG. 2 is a block diagram illustrating functional constituents of the X-ray radiation device depicted in FIG. 1.

FIG. 2 is a block diagram illustrating functional constituents of the X-ray radiation device 1. As depicted, the controller 4 has a control circuit 23 for controlling the X-ray radiation units 3. The control circuit 23 is externally connectable to the X-ray radiation units 3 and the like through an I/O terminal 24. In this embodiment, power supplied to each X-ray radiation unit 3 is assumed to be constant, and control for supplied power such as feedback control for homogenizing radiation conditions for the X-ray radiation units 3 is not performed.

On the other hand, the X-ray radiation unit 3 has an X-ray tube 6 for generating X-rays, a high voltage generation module 21 for raising a voltage supplied from a power circuit 23*a* (which will be explained later), and a drive circuit 15 for driving the X-ray tube 6 and high voltage generation module 21. A trunk line 22 is connected to the drive circuit 15 and can externally be connected through I/O terminals 7, 8 provided at both ends thereof to other X-ray radiation units 3, the controller 4, and the like.

In the X-ray radiation device 1, as illustrated in FIGS. 1 and 2, the I/O terminal 8 of one X-ray radiation unit 3 is detachably connected through a flexible relay cable 25 to the I/O terminal 7 of another X-ray radiation unit 3 adjacent thereto. While the X-ray radiation units 3 are similarly connected to each other up to the X-ray radiation unit 3 at the leading end, the I/O terminal 24 of the controller 4 is detachably connected to the I/O terminal 7 of the X-ray radiation unit 3 at the base end through the relay cable 25. This connects the trunk lines 22 of the X-ray radiation units 3 in series and the driving circuits 15 of the X-ray radiation units 2 in parallel to the control circuit 23.

Hence, the voltage value inputted from the I/O terminal 7 and the voltage value outputted from the I/O terminal 8 are equal to each other in one X-ray radiation unit 3. The voltage value outputted from the I/O terminal 8 of one X-ray radiation unit 3 is also equal to each of the voltage value inputted from the I/O terminal 7 of another X-ray radiation unit 3 electrically connected to the former X-ray radiation unit 3 and the voltage value outputted from the I/O terminal 8 of the latter X-ray radiation unit 3. Thus, even when a plurality of X-ray radiation units 3 are connected in a row, the same voltage value can be supplied to all the X-ray radiation units 3. Therefore, the X-ray radiation units 3 can electrically be connected together and are not required to be connected one by one to the control circuit 23 of the controller 4 including the power circuit 23*a* that will be explained later. This makes it possible to increase and decrease the number of X-ray radiation units 3 without complicating the wiring.

Thus, the relay cables 25 detachably connect the X-ray radiation units 3 to each other and the X-ray radiation units 3 and the controller 4 to each other, thereby making it easier to increase and decrease the number of units. Adjusting the length of the relay cables 25 or bending them can easily regulate intervals between the units or change their arrangement.

The structure of the above-mentioned X-ray radiation units 3 will now be explained in detail.

Figure 3:
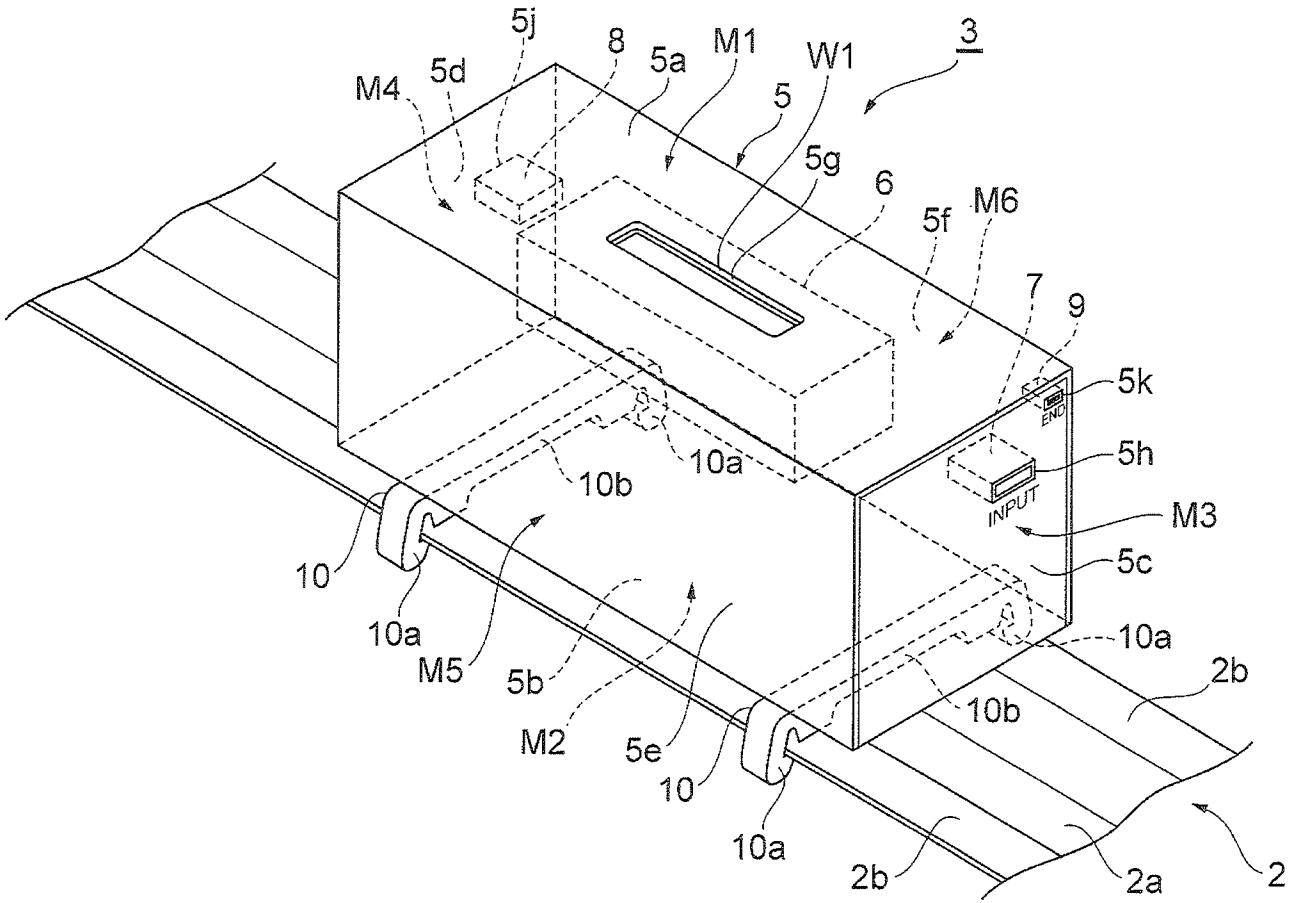
FIG. 3 is a perspective view of the X-ray radiation unit illustrated in FIG. 1.
Figure 4:
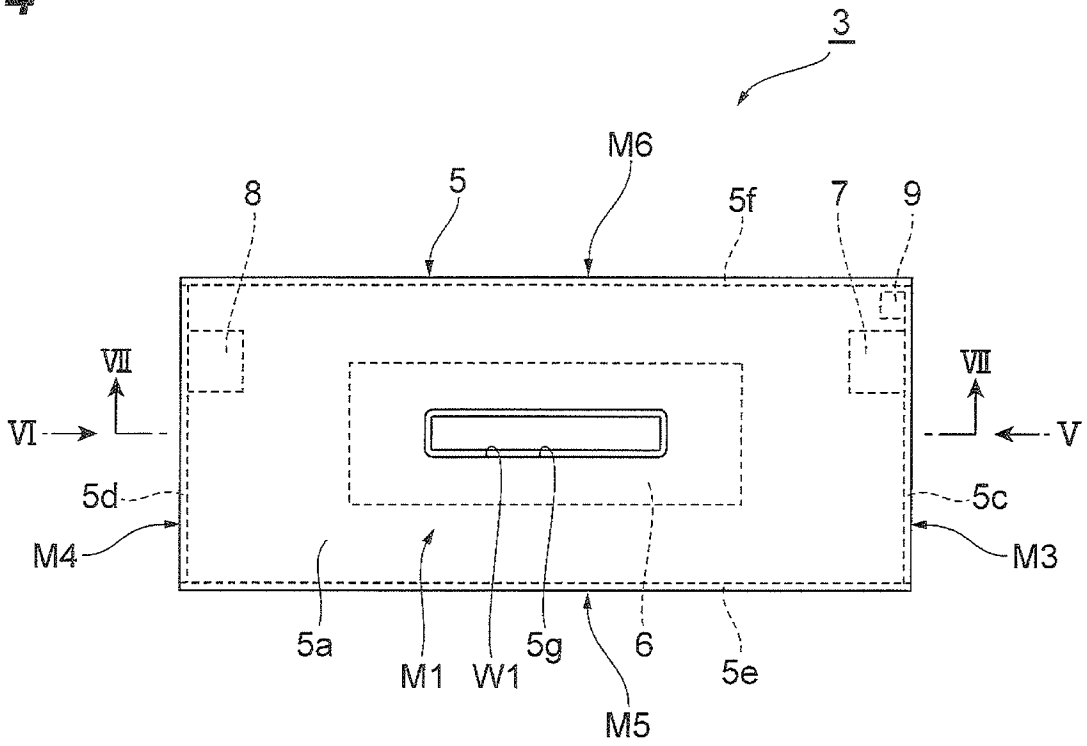
FIG. 4 is a plan view of the X-ray radiation unit illustrated in FIG. 3.
Figure 5:
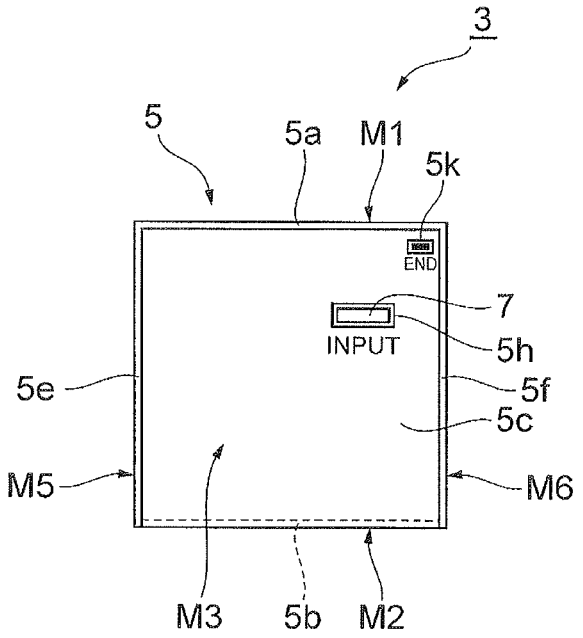
FIG. 5 is a view taken in the direction of arrow V in FIG. 4.
Figure 6:
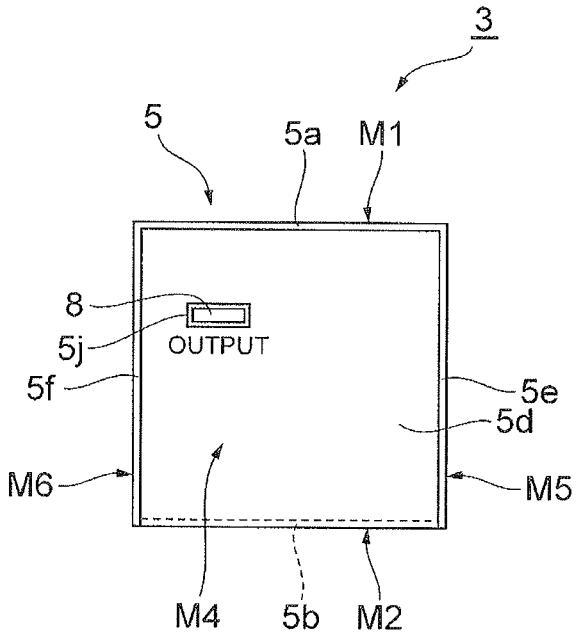
FIG. 6 is a view taken in the direction of arrow VI in FIG. 4.
Figure 7:
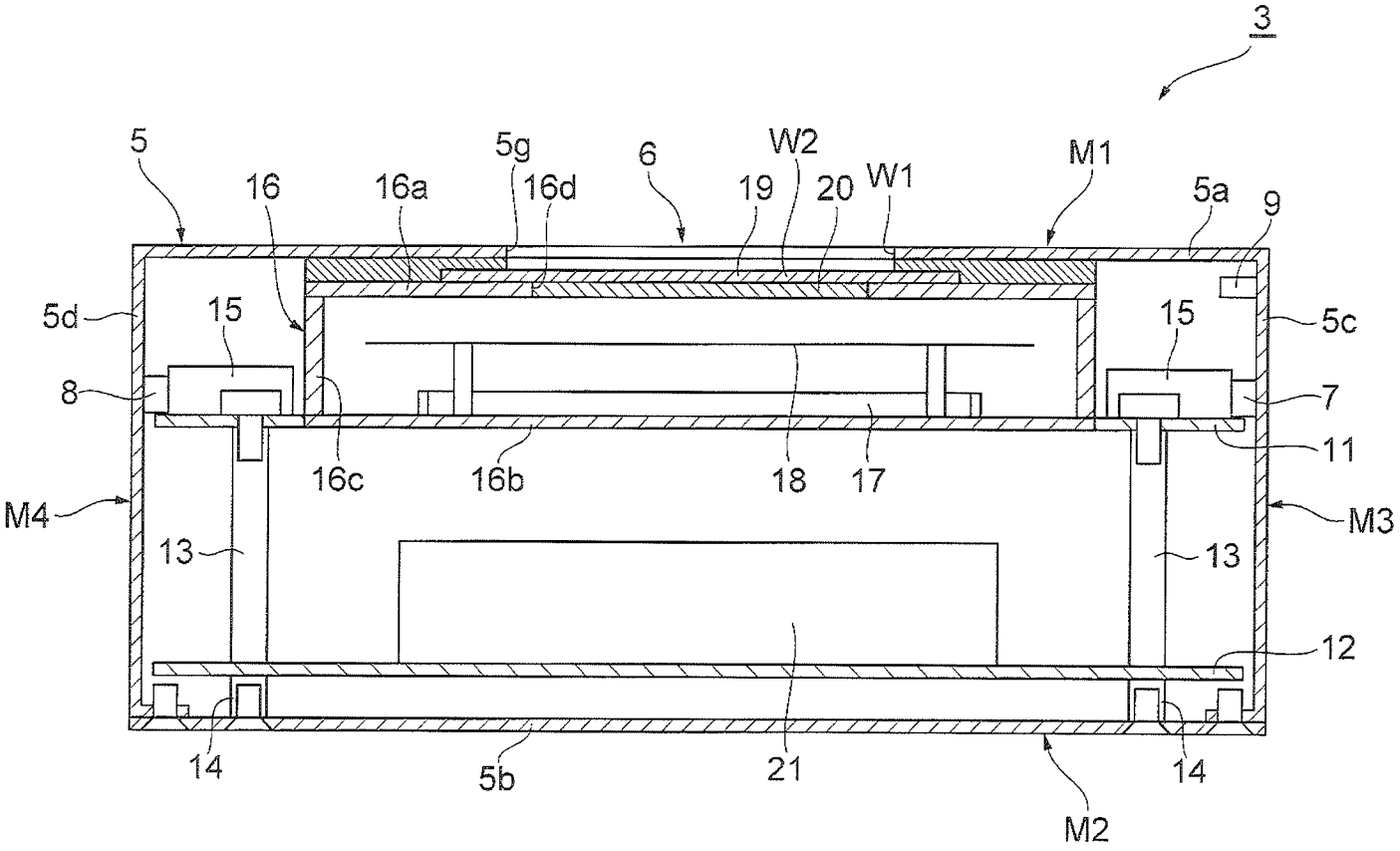
FIG. 7 is a sectional view taken along the line VII-VII of FIG. 4.

FIG. 3 is a perspective view of the X-ray radiation unit illustrated in FIG. 1. FIG. 4 is a plan view of the X-ray radiation unit illustrated in FIG. 3. FIG. 5 is a view taken in the direction of arrow V in FIG. 4, FIG. 6 is a view taken in the direction of arrow VI in FIG. 4, and FIG. 7 is a sectional view taken along the line VII-VII of FIG. 4. As illustrated in FIGS. 3 to 7, each X-ray radiation unit 3 contains the above-mentioned X-ray tube 6, drive circuit 15, high voltage generation module 21, I/O terminals 7, 8, and the like in a housing 5, made of stainless steel, aluminum, or the like, having a substantially rectangular parallelepiped form. The housing 5 constructs a shield against physical shocks, electromagnetic wave noise, and the like which may affect the X-ray radiation unit 3.

The housing 5 has substantially rectangular wall parts 5*a*, 5*b* opposing each other, a pair of side wall parts 5*c*, 5*d* opposing each other on the shorter sides of the wall parts 5*a*, 5*b*, and a pair of side wall parts 5*e*, 5*f* opposing each other on the longer sides of the wall parts 5*e*, 5*f*.

The wall part 5*a* is formed with an opening 5*g* elongated in the longitudinal direction of the wall part 5*a*. On the inside of the wall part 5*a*, the X-ray tube 6 is arranged at a position corresponding to the opening 5*g* (see FIG. 3). X-rays generated by the X-ray tube 6 are emitted to the outside of the housing 5 through the opening 5*g* serving as an X-ray emission part W1. That is, the outer surface of the wall part 5*a* serves as the X-ray emission surface M1 provided with the X-ray emission part W1 through which the X-rays generated by the X-ray tube 6 are emitted. The outer surface of the wall part 5*b* is a back face M2 opposing the X-ray emission surface M1. The outer surfaces of the side wall parts 5*c*, 5*d* are a pair of side faces M3, M4 intersecting the X-ray emission surface M1 and opposing each other. The outer surfaces of the side wall parts 5*e*, 5*f* are a pair of side faces M5, M6 intersecting the X-ray emission surface M1 and opposing each other.

The side wall part 5*c* is formed with an opening 5*h*. On the inside of the side wall part 5*c*, the I/O terminal 7 is arranged at a position corresponding to the opening 5*h* (see FIG. 5). The I/O terminal 7 opens to the outside of the housing 5 through the opening 5*h*. The side wall part 5*d* is formed with an opening 5*j*. On the inside of the side wall part 5*d*, the I/O terminal 8 is arranged at a position corresponding to the opening 5*j* (see FIG. 6). The I/O terminal 8 opens to the outside of the housing 5 through the opening 5*j*. The I/O terminals 7, 8 thus open respectively at the side faces M3, M4 of the housing intersecting the X-ray emission surface M1 of the housing 5, whereby the relay cable 25 connected to the I/O terminals 7, 8 is hard to extend in the X-ray emission direction. This can prevent the relay cable 25 from obstructing the X-ray emission. Since the connection with the relay cable 25 can be made along the extending direction of the X-ray emission part W1, an elongated radiation area is easy to form, and the relay cable 25 can also be attached and detached easily while being held by the rail member 2. Examples of the I/O terminals 7, 8 include connectors such as those of Mini-USB.

The side wall part Sc is further formed with a life display window 5*k*, while a life display LED 9 which is a light-emitting device is arranged on the inside of the housing 5. As will be explained later, the life display LED 9 is a device which generates visible light when the life of the X-ray tube 6 is detected. The life display LED 9 emits visible light from the life display window 5*k* to the outside of the housing 5.

The housing 5 is arranged such that the back face M2 opposes the rail member 2, while the opposing direction of the pair of side faces M3, M4 lies along the rail member 2, and is attached to the rail member 2 through two joint members 10. As a consequence, the longer sides of the X-ray emission surface M1 of the housing 5 become parallel to the rail member 2, which can restrain the X-ray radiation device 1 from widening in the width direction of the rail, so as to save space. Since the opposing direction of the side faces M3, M4 lies along the extending direction of the rail member 2, the I/O terminals 7, 8 of the X-ray radiation units 3 adjacent to each other oppose each other. This arranges the X-ray radiation units 3 and relay cables 25 alternately along the extending direction of the rail member 2, thereby making it easier to increase and decrease the number of X-ray radiation units 3, and can restrain the X-ray radiation device 1 from widening in the width direction of the rail member 2, so as to save space.

Each joint member 10 is made of an elastic insulating material such as a resin. Each joint member 10 comprises a rod-shaped main part 10*b* having a rectangular cross section with a length substantially equal to the width of the rail member 2 and claws 10*a*, 10*a* respectively formed at both ends of the main part 10*b*. Securing the main part 10*b* to the back face M2 by screwing and the like and letting the claws 10*a*, 10*b* engage the respective end portions of the flanges 2*b*, 2*b* of the rail member by using their elasticity attaches the X-ray radiation unit 3 detachably and slidably to the rail member 2. While external noise may transfer to the rail member 2 made of a metal and further to the housing 5, the joint members 10 made of an insulating material block the electric connection between the rail member 2 and the housing 5, thereby preventing the electric noise from transferring from the rail member 2 to the housing 5. This enables the X-ray radiation unit 3 to operate stably.

As illustrated in FIG. 1, the joint member 10 may additionally be attached between the X-ray radiation units 3, 3, so as to bind a middle part of the relay cable 25, which connects the X-ray radiation units 3, 3 to each other, to the rail member 2. Thus utilizing the joint members 10 can hold the relay cables 25 near the rail member 2 and more reliably prevent the relay cables 25 from obstructing the X-ray radiation to the object for electricity removal.

Within the housing 5, as illustrated in FIG. 7, a substrate 11 mounted with the X-ray tube 6 and drive circuit 15 and a substrate 12 mounted with the high voltage generation module 21 are arranged parallel to the wall parts 5*a*, 5*b*. The substrates 11, 12 are arranged in this order from the wall part 5*a* side to the wall part 5*b* side. The substrates 11, 12 are secured to each other with spacers 13, while the substrate 12 is secured to the wall part 5*b* with spacers 14.

The X-ray tube 6 contains within a vacuum envelope 16 a filament 17 for generating an electron beam and a grid 18 for accelerating the electron beam. The vacuum envelope 16 has a wall part 16*a* located on the wall part 5*a* side, a wall part 16*b* located on the substrate 11 side so as to oppose the wall part 16*a*, and a side wall part 16*c* extending along the outer edges of the wall parts 16*a*, 16*b*.

The filament 17 is arranged on the wall part 16*b* side, while the grid 18 is placed between the wall part 16*a* and the filament 17. The wall part 16*a* is formed with an opening 16*d*. A window member 19 made of a favorably radiolucent, conductive material such as beryllium, silicon, or titanium, for example, is closely secured to the outer surface of the wall part 16*a* so as to seal the opening 16*d*, thereby producing an X-ray emission window W2. In the inner surface of the window member 19, at least a part corresponding to the opening 16*d* is formed with a target 20. The target 20 is made of tungsten, for example, and generates X-rays in response to the electron beam incident thereon. The X-ray tube 6 is arranged on the substrate 11 such that the X-ray emission window W2 is located within the area of the opening 5*g* (X-ray emission part W1) of the housing 5, while the drive circuit 15 is arranged thereabout.

When the X-ray tube 6 is driven by the drive circuit 15, the electron beam drawn by the grid 18 from the filament 17 is accelerated toward the target 20, so as to be made incident on the target 20. When the electron beam is incident on the target 20, X-rays are generated. Thus generated X-rays are emitted through the X-ray emission window W2 to the outside of the vacuum envelope 16 and further through the opening 5*g* (X-ray emission part W1) to the outside of the housing 5. Thus, the X-rays are emitted from the X-ray radiation unit 3.

The circuit configuration of the X-ray radiation device 1 will now be explained.

Figure 8:
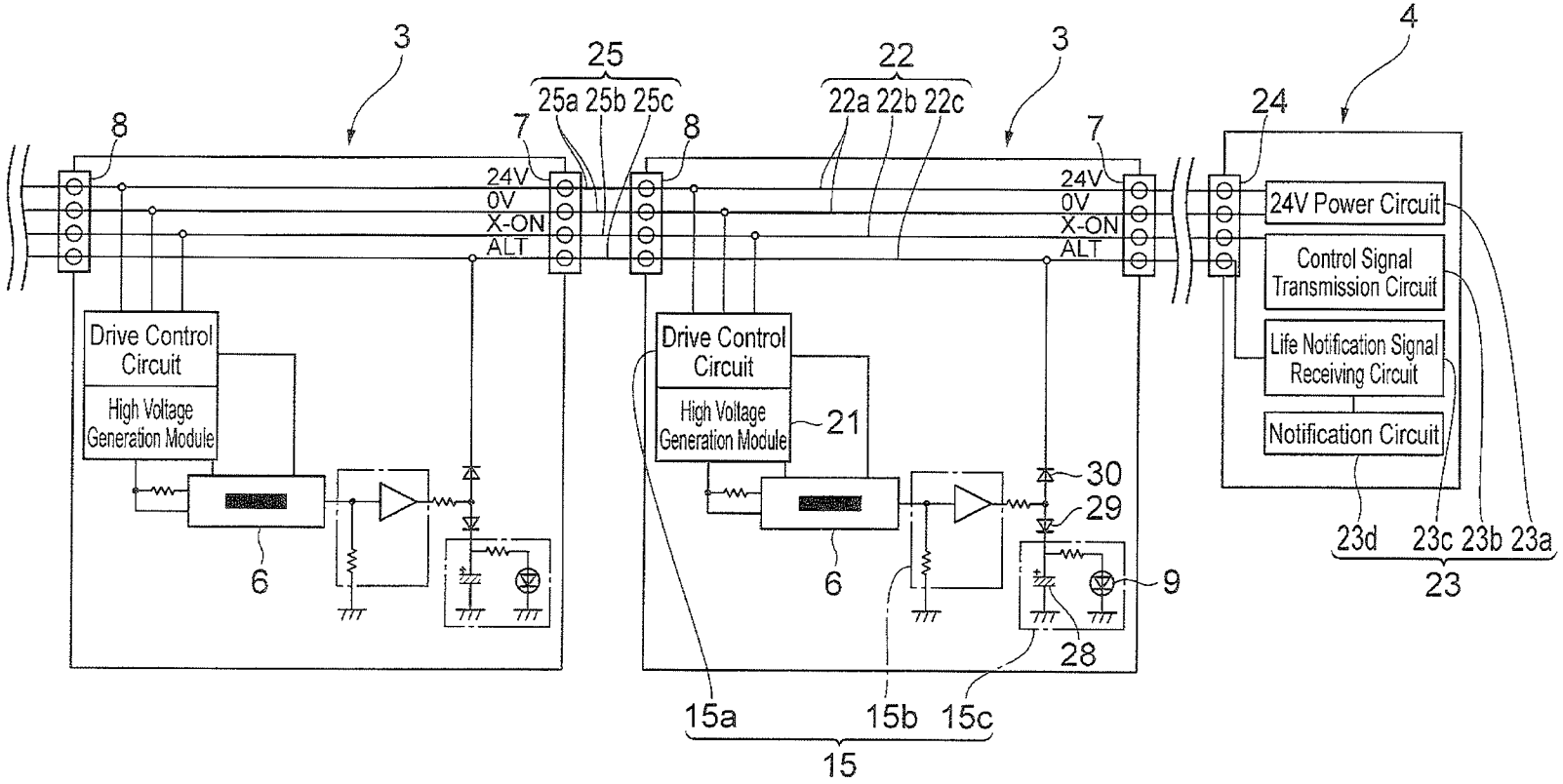
FIG. 8 is a schematic circuit diagram of the X-ray radiation device illustrated in FIG. 1.

FIG. 8 is a schematic circuit diagram of the X-ray radiation device illustrated in FIG. 1. As depicted, the control circuit 23 has the power circuit 23*a*, a control signal transmission circuit 23*b*, a life notification signal receiving circuit 23*c*, and a notification circuit 23*d*. The power circuit 23*a* supplies power to the drive circuit 15. The control signal transmission circuit 23*b* transmits a control signal for driving and stopping the X-ray tubes 6. The life notification signal receiving circuit 23*c* receives a life notification signal concerning the life of the X-ray tubes 6. The notification circuit 23*d* displays visually by a light-emitting device such as LED or a screen or audibly by sounding an alarm or the like the fact that the life notification signal receiving circuit 23*c* has received the life notification signal. Each of the power circuit 23*a*, control signal transmission circuit 23*b*, and life notification signal receiving circuit 23*c* is connected to the I/O terminal 24.

The trunk line 22 of each X-ray radiation unit 3 has a pair of power lines 22*a*, 22*a*, a control signal line 22*b*, and a life notification signal line 22*c*. The power lines 22*a*, 22*a* transmit power to the drive circuit 15; for example, one of them functions as a high voltage line for supplying 24 V, while the other functions as a ground line for supplying 0 V. The control signal line 22*b* feeds the drive circuit 15 with the control signal transmitted from the control signal transmission circuit 23*b*. The life notification signal line 22*c* transmits the life notification signal concerning the life of the X-ray tube 6 to the life notification signal receiving circuit 23*c*. Both end portions of each of the power line 22*a*, control signal line 22*b*, and life notification signal line 22*c* are connected to the I/O terminals 7, 8, respectively.

The relay cable 25 has a pair of power relay lines 25*a*, 25*a*, a control signal relay line 25*b*, and a life notification signal relay line 25*c*. The power relay line 25*a* connects the power lines 22*a* to each other or the power line 22*a* and the power circuit 23*a* to each other. The control signal relay line 25*b* connects the control signal lines 22*b* to each other or the control signal line 22*b* and the control signal transmission circuit 23*b* to each other. The life notification signal relay line 25*c* connects the life notification signal lines 22*c* to each other or the life notification signal line 22*c* and the life notification signal receiving circuit 23*c* to each other.

Figure 9:
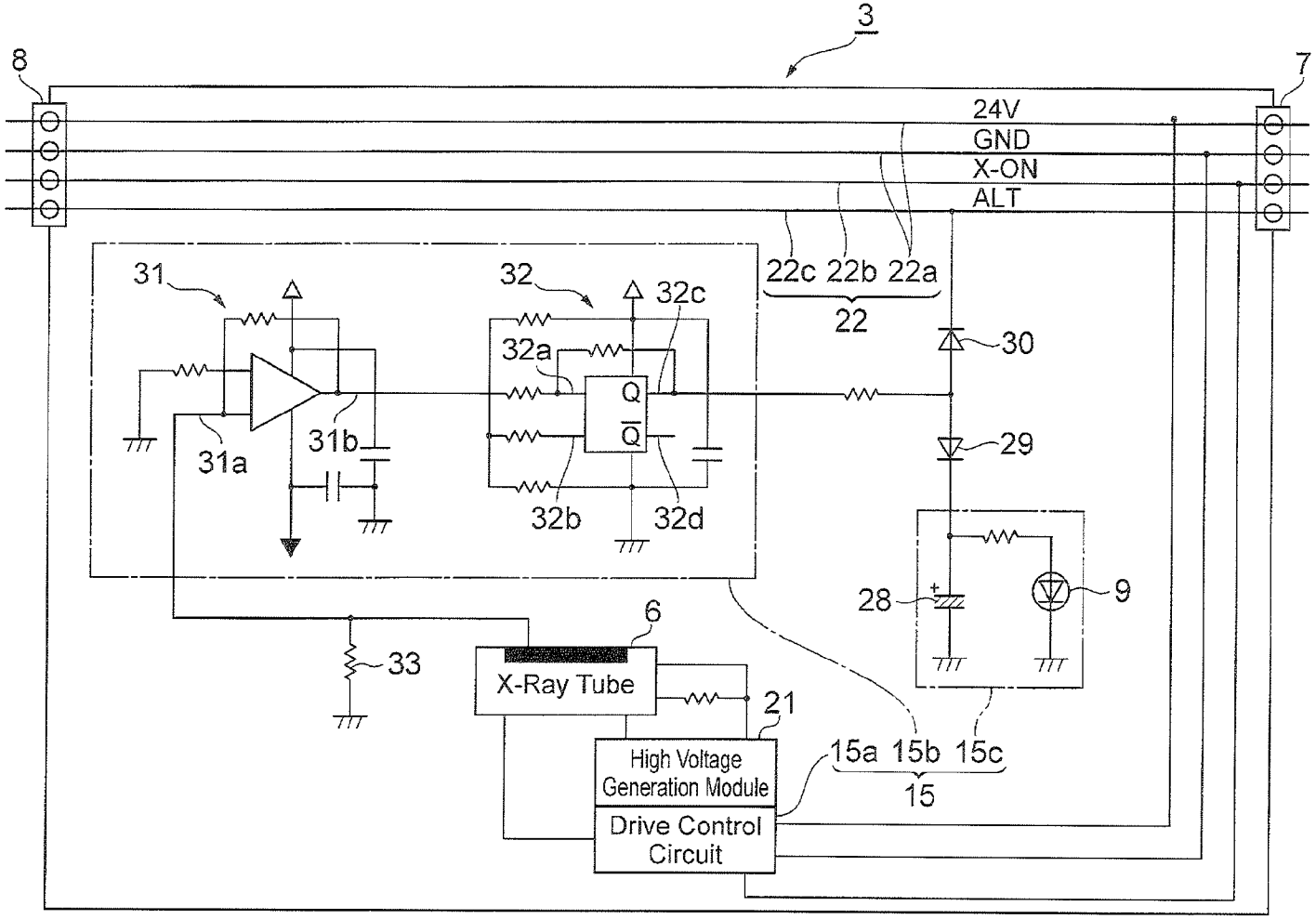
FIG. 9 is a circuit diagram of the X-ray radiation unit illustrated in FIG. 1.

FIG. 9 is a circuit diagram of the X-ray radiation unit illustrated in FIG. 1. As depicted, the drive circuit 15 of the X-ray radiation unit 3 has a drive control circuit 15*a*, a life detection circuit 15*b*, and a display circuit 15*c*. The drive control circuit 15*a* is connected to the power lines 22*a* and control signal line 22*b*. The power lines 22*a* supply the drive control circuit 15*a* with power for driving the X-ray tube 6. The drive control circuit 15*a* receives the control signal from the control signal line 22*b*, so as to control the driving and stopping of the X-ray tube 6.

The life detection circuit 15*b* has an operational amplifier circuit 31 and a comparator circuit 32. The operational amplifier circuit 31 has an input part 31*a* and an output part 31*b*, amplifies a voltage inputted to the input part 31*a*, and outputs thus amplified voltage from the output part 31*b*. For determining the life of the X-ray tube 6, this embodiment uses a target current (drive current) indicating the amount of electrons incident on the target 20 therein. When the amount of electrons incident on the target 20 decreases (i.e., the target current lowers) due to deterioration in the filament 17, foreign matters such as sputtered materials lowering the withstand voltage between the filament 17 and the grid 18, and the like, the amount of X-rays may become so small that the target current cannot be used for determining the life. The target current from the X-ray tube 6 flows into a path connecting the X-ray tube 6 and the life detection circuit 15*b* to each other, while a resistance 33 is arranged on this path, so that a voltage proportional to the target current occurs between both end parts of the resistance 33. The voltage generated between both end parts of the resistance 33 is inputted to the input part 31*a*. As a consequence, the voltage proportional to the target current of the X-ray tube 6 is outputted from the output part 31*b*.

The comparator circuit 32 has a pair of input parts 32*a*, 32*b* and a pair of output parts 32*c*, 32*d*, compares the respective voltages inputted to the input parts 32*a*, 32*b* with each other, and outputs a voltage corresponding to the result of comparison from the output parts 32*c*, 32*d*. Specifically, when the voltage inputted to the input part 32*a* is not higher than the voltage inputted to the input part 32*b*, the voltage at the output part 32*d* is set to 0 V, and a voltage higher than 0 V is outputted from the output part 32*c*. When the voltage inputted to the input part 32*a* is higher than the voltage inputted to the input part 32*b*, the voltage at the output part 32*c* is set to 0 V, and a voltage higher than 0 V is outputted from the output part 32*d*.

The voltage at the output part 31*b* of the operational amplifier circuit 31 is inputted to the input part 32*a* of the comparator circuit 32. On the other hand, a preset voltage is inputted to the input part 32*b*. The voltage proportional to the target current of the X-ray tube 6 and the preset voltage are compared with each other. That is, the target current value of the X-ray tube 6 and a preset threshold are compared with each other, and the life of the X-ray tube 6 is detected according to the relationship in magnitude between the target current value of the X-ray tube 6 and the threshold. Thus, the life of the X-ray tube 6 can be detected clearly according to a uniform reference.

Here, the life of the X-ray tube 6 is detected when the target current value of the X-ray tube 6 is not higher than the threshold. The threshold is a value falling within the range from 70% to 90% of a rated value of the target current, for example. When the target current value of the X-ray tube 6 is not higher than the threshold, the voltage at the output part 32*d* is set to 0 V, and a voltage higher than 0 V is outputted from the output part 32*c*. When the target current value of the X-ray tube 6 is higher than the threshold, the voltage of the output part 32*c* is set to 0 V, and a voltage higher than 0 V is outputted from the output part 32*d*.

The display circuit 15*c* has the life display LED 9 and a capacitor 28 connected in parallel to the life display LED 9. The cathode side of the life display LED 9 and the negative electrode side of the capacitor 28 are grounded. The capacitor 28 is an electrical double-layer capacitor. The life display LED 9 and capacitor 28 are connected to the output part 32*c* of the comparator circuit 32 through a diode 29 which is a rectifying device. The diode 29 allows a current to flow therethrough unidirectionally from the output part 32*c* to the display circuit 15*c*. When the comparator circuit 32 outputs a voltage from the output part 32*c*, power is supplied to the life display LED 9 and capacitor 28. That is, the output part 32*c* serves as a life notification output part which supplies power to the display circuit 150 upon detection of the life of the X-ray tube 6. The life display LED 9 generates visible light according to the power supplied from the output part 32*c*. The capacitor 28 receives a part of the power supplied from the output part 32*c* and accumulates it.

The output part 32*c* connected to the life display LED 9 and capacitor 28 is further connected to the life notification signal line 22*c* in the trunk line 22. The diode 30 allows a current to flow therethrough unidirectionally from the output part 32*c* to the life notification signal line 22*c*. The voltage outputted from the output part 32*c* by the comparator circuit 32 is fed to the life notification signal line 22*c* as a life notification signal concerning the life of the X-ray tube 6.

Operations of the X-ray radiation device 1 will now be explained.

Figure 10:
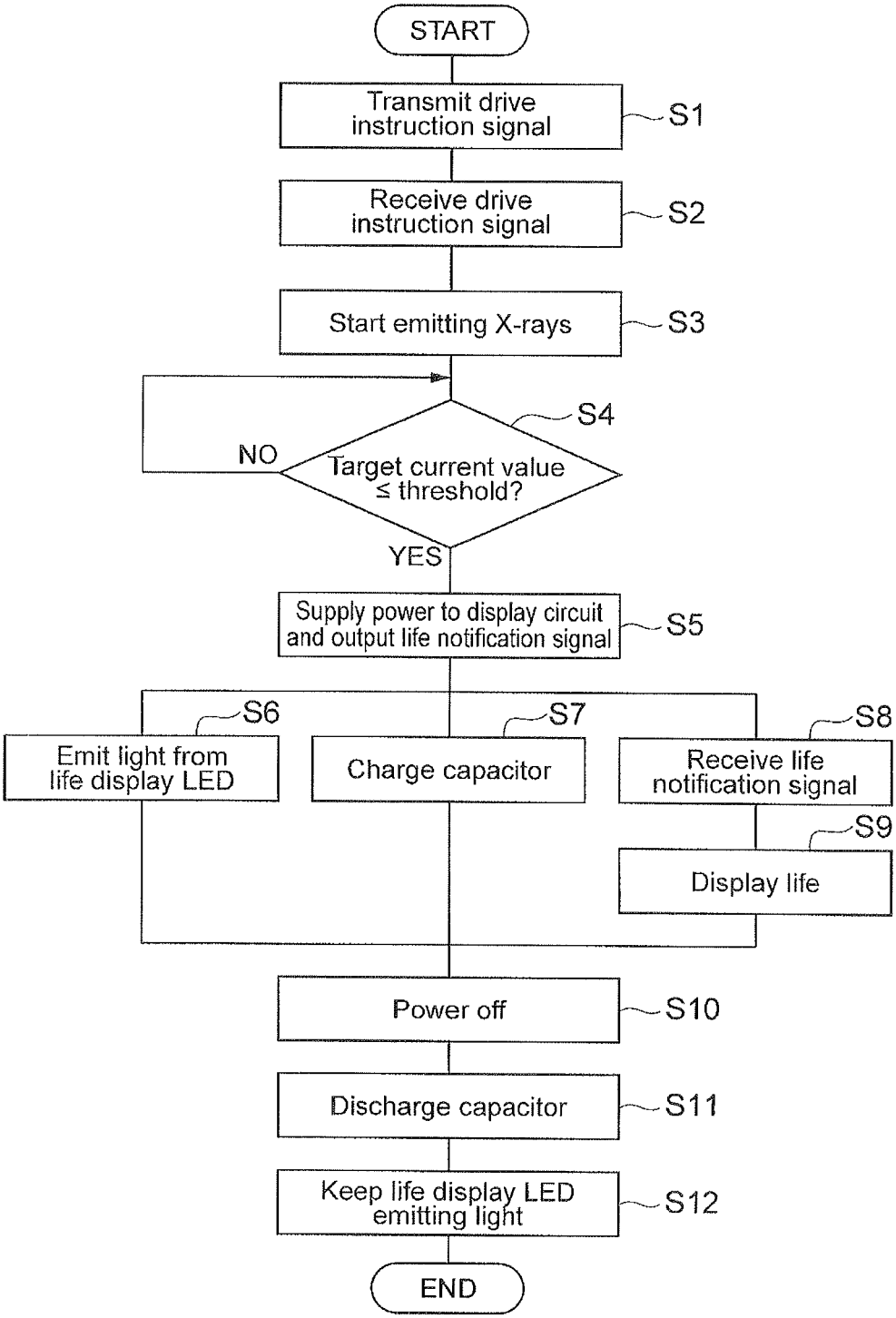
FIG. 10 is a flowchart illustrating a procedure of operating the X-ray radiation device depicted in FIG. 1.

FIG. 10 is a flowchart illustrating a procedure of operating the X-ray radiation device depicted in FIG. 1. First, as depicted, the control signal transmission circuit 23*b* of the controller 4 transmits a control signal for driving the X-ray tubes 6 (step S1), and the drive control circuits 15*a* of all the X-ray radiation units 3 receive this control signal (step S2). Upon receiving the control signal, the drive control circuits 15*a* drive the X-ray tubes 6 through the high voltage generation modules 21. As a consequence, all the X-ray radiation units 3 start emitting X-rays (step S3). An object for electrostatic removal is arranged on the X-ray emission surface M1 side of the X-ray radiation units 3. The X-ray radiation units 3 irradiate a gas such as air interposed between the object and the X-ray radiation units 3 with X-rays, so as to generate an ion gas. This ion gas removes electricity of the object.

Next, the life detection circuit 15*b* compares the target current value of the X-ray tube 6 with a threshold (step S4). When the target value of the X-ray tube 6 is higher than the threshold, the irradiation with the X-rays is continued. When the target value of the X-ray tube 6 is not higher than the threshold, a voltage higher than 0 V is outputted from the output part 32*c* of the comparator circuit 32. This supplies power to the display circuit 15*c* and outputs a life notification signal (step S5).

When power is supplied to the display circuit 15*c*, the life display LED 9 emits light (step S6), and the capacitor 28 is charged (step S7). In the X-ray radiation unit 3 in which the life of the X-ray tube 6 is not detected, the diode 30 prevents the power generated by another X-ray radiation unit 3 from flowing into the display circuit 15*c* through the output part 32*c*, thus prohibiting the life display LED 9 from emitting tight. This can notify an administrator and the like of from which X-ray radiation unit 3 the life notification signal is transmitted.

When the life notification signal is outputted, the life notification signal receiving circuit 23*c* of the control circuit 23 receives the life notification signal through the life notification signal line 22*c* and life notification signal relay line 25*c* (step S8). When the life notification signal is received by the life notification signal receiving circuit 23*c*, the notification circuit 23*d* displays the fact that the life notification signal is received (step S9). This can notify through the controller 4 the administrator and the like of the reception of the life notification signal.

When the power of the X-ray radiation device 1 is turned off in order to replace the X-ray tube 6 (step S10), the power accumulated in the capacitor 28 is discharged to the life display device LED 9 (step S11), by which the life display device LED 9 keeps emitting light (step S12). As a consequence, even after the power of the X-ray radiation device 1 is turned off, the administrator and the like can be notified of from which X-ray radiation unit 3 the life notification signal is transmitted. Here, the diode 29 prevents the power accumulated in the capacitor 28 from being discharged through the life detection circuit 15*b*, whereby the life display LED 9 can reliably be supplied with the power accumulated in the capacitor 28, so as to emit light. Since the capacitor 28 is an electrical double-layer capacitor having a high charging efficiency, a large amount of power is accumulated in the capacitor 28 in a short time, whereby the life display LED 9 can keep emitting light for a longer period of time. In the X-ray radiation unit 3 in which the life of the X-ray tube 6 is not detected, on the other hand, no power is accumulated in the capacitor 28, whereby the life display LED 9 emits no light.

The X-ray radiation device 1 explained in the foregoing connects a plurality of trunk lines 22 in series to the control circuit 23, whereby a plurality of drive circuits 15 are connected in parallel to the control circuit 23, which enables the controller 4 to control all the X-ray radiation units 3 connected. Since the plurality of trunk lines 22 are connected in series to the control circuit 23, the individual X-ray radiation units 3 can be connected to each other and are not required to be connected one by one to the controller 4. The relay cables 25 for connections are joined together in a row. Hence, the number of units can be increased and decreased without complicating the wiring.

A modified example of this embodiment will now be explained.

Figure 11:
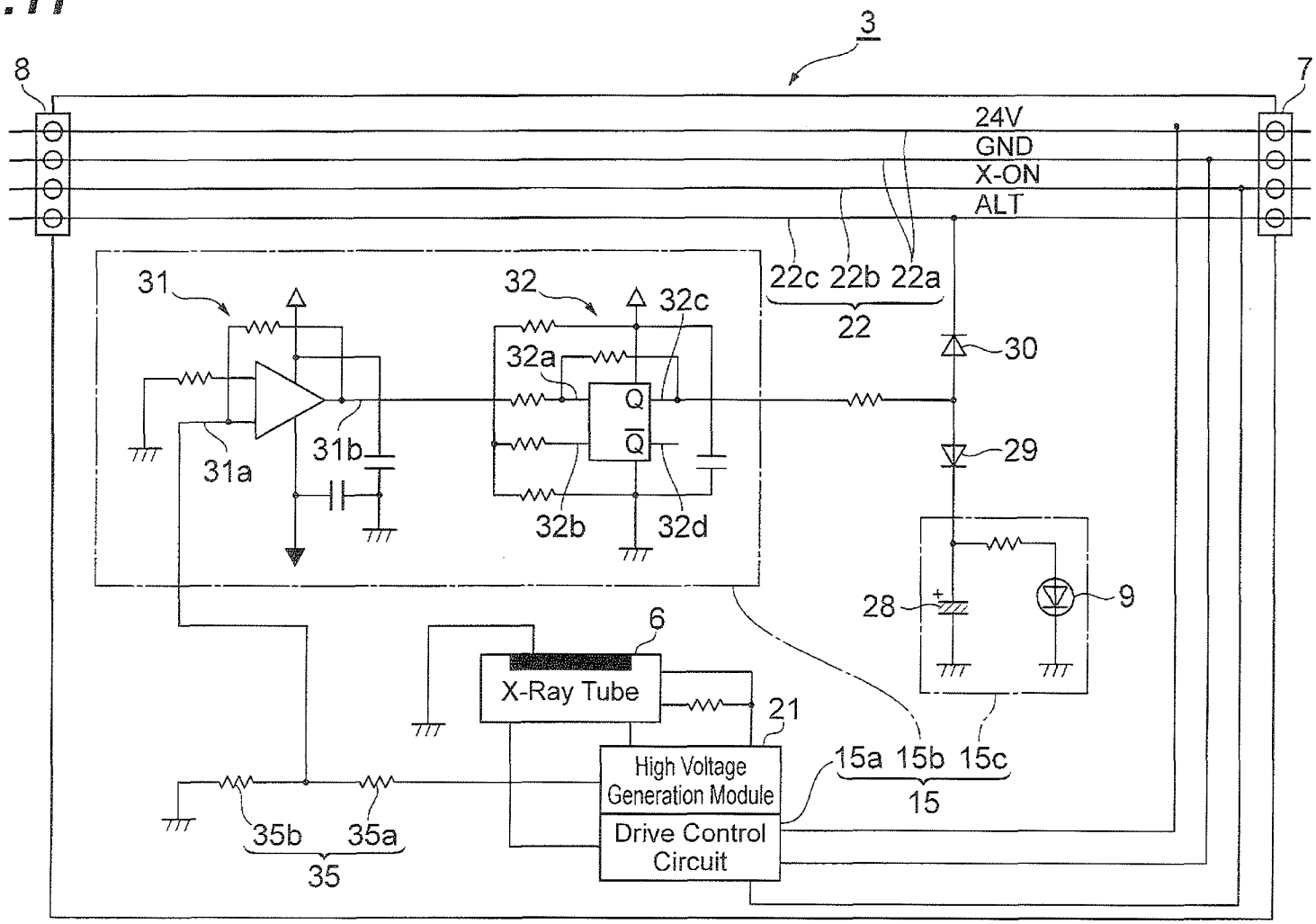
FIG. 11 is a circuit diagram illustrating a modified example of the X-ray radiation unit.

FIG. 11 is a circuit diagram illustrating a modified example of the X-ray radiation unit 3. The modified example illustrated in this diagram uses a tube voltage (drive voltage) in place of the target current for determining the life. The tube voltage is a voltage applied between the filament 17 and the target 20 by the high voltage generation module 21. Since the amount of X-rays decreases when the tube voltage drops due to a reduction in the withstand voltage between the filament 17 and the target 20 and the like, the tube voltage can be used for determining the life.

For lowering the tube voltage such that it can be used for determining the life, a step-down circuit 35 is connected to the high voltage generation module 21, while the tube voltage is applied to the step-down circuit 35. The step-down circuit 35 has two resistances 35*a*, 35*b* connected in series. An end part on the resistance 35*a* side of the step-down circuit 35 is connected to the high voltage generation module 21, while an end part on the resistance 35*b* side of the step-down circuit 35 is grounded. The tube voltage is divided according to the ratio between the resistance value of the resistance 35*a* and that of the resistance 35*b*. Hence, the step-down circuit 35 lowers the tube voltage at a fixed ratio and outputs thus lowered voltage from between the resistances 35*a*, 35*b*. The ratio by which the tube voltage is lowered is the ratio of the resistance value of the resistance 35*b* to the total of the resistance values of the resistances 35*a*, 35*b*. For fully lowering the tube voltage, it is preferred for the resistance 35*a* to have a resistance value higher than that of the resistance 35*b*.

The voltage outputted from the step-down circuit 35 is inputted to the input part 31*a* of the operational amplifier circuit 31 instead of the voltage proportional to the target current. The voltage at the output part 31*b* of the operational amplifier circuit 31 is inputted to the input part 32*a* of the comparator circuit 32. On the other hand, a preset voltage is inputted to the input part 32*b* of the comparator circuit 32. The voltage proportional to the tube voltage of the X-ray tube 6 and the preset voltage are compared with each other. That is, the tube voltage value of the X-ray tube 6 and a preset threshold are compared with each other, and the life of the X-ray tube 6 is detected according to the relationship in magnitude between the tube voltage value of the X-ray tube 6 and the threshold. Here, the life of the X-ray tube 6 is detected when the tube voltage value of the X-ray tube 6 is not higher than the threshold. The threshold is a value falling within the range from 85% to 95% of a rated value of the tube voltage of the X-ray tube 6, for example. This modified example can also clearly detect the life of the X-ray tube 6 according to a uniform reference.

In the above-mentioned embodiment and modified example, the life detection circuit 15*b* detects as the life the fact that the X-ray tube fails to satisfy a predetermined drive condition not only due to wear of its constituent members used for a long period of time, but also because of malfunctions caused by unexpected damages during use and the like such as vacuum leaks from the X-ray tube 6 (vacuum envelope 16) and breaking of the filament 17, for example, regardless of whether the period of use is long or short. When the X-ray tube 6 has malfunctions from the start or when malfunctions such as failure and deterioration occur in the drive control circuit 15*a* and high voltage generation module 21 of the X-ray radiation unit 3, the life detection circuit 15*b* also detects them according to the fact that a predetermined drive condition is not satisfied. That is, the life detection circuit 15*b* can detect not only the life of the X-ray tube 6, but also malfunctions of the X-ray tube 6, drive control circuit 15*a*, and high voltage generation module 21 and thus can determine whether or not they can be used as the X-ray radiation unit 3.

Other examples of arrangement of X-ray radiation units will now be explained.

Figure 12:
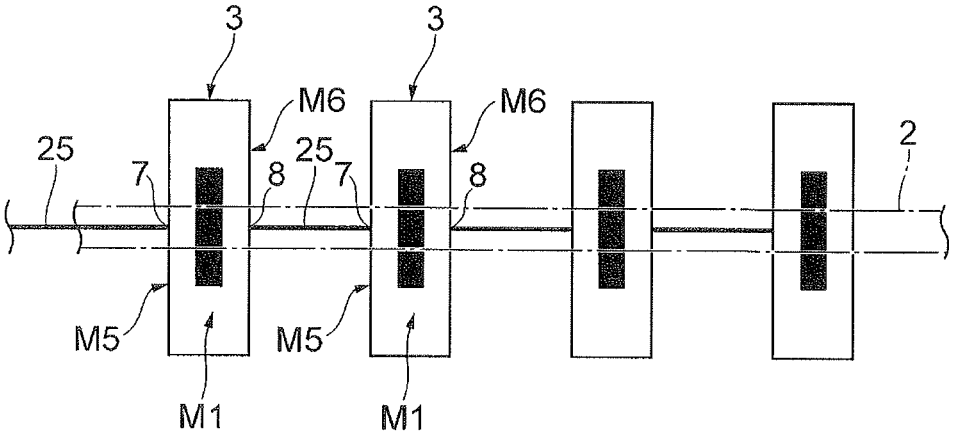
FIG. 12 is a diagram illustrating another example of arrangement of X-ray radiation units.

FIG. 12 illustrates an example in which the shorter sides of the X-ray emission surface M1 are arranged parallel to the rail member 2. In this arrangement example, input and output terminals 7, 8 open at the side faces M5, M6 on the longer sides of the X-ray emission surface M1, respectively.

Figure 13:
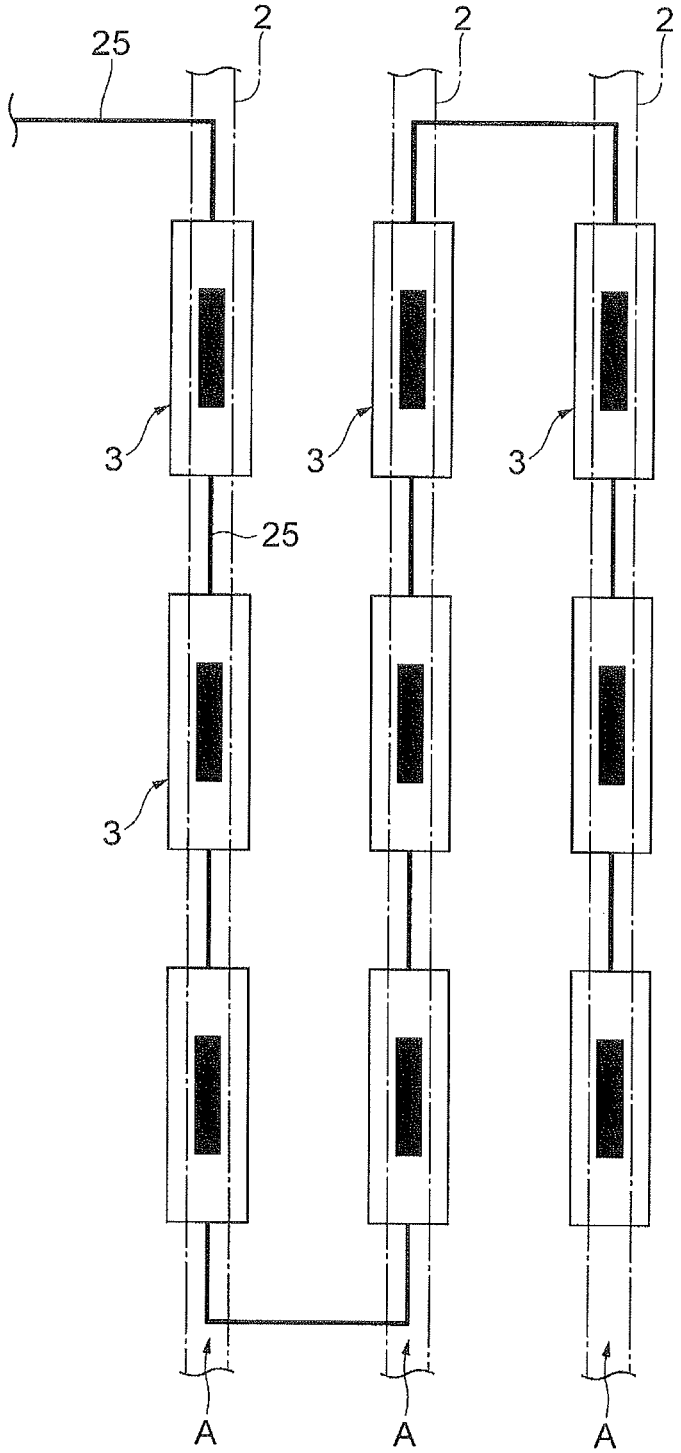
FIG. 13 is a diagram illustrating still another example of arrangement of X-ray radiation units.
Figure 14:
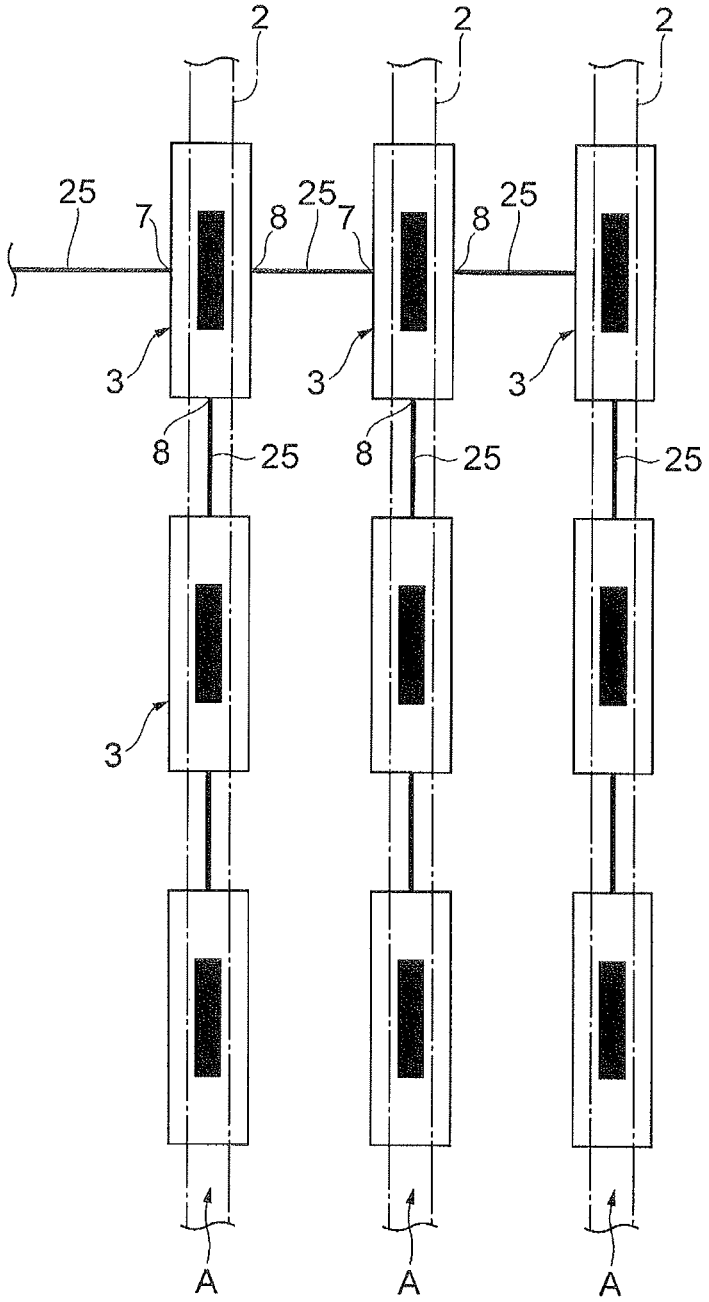
FIG. 14 is a diagram illustrating yet another example of arrangement of X-ray radiation units.

FIGS. 13 and 14 illustrate examples in which a plurality of X-ray radiation units 3 are distributively attached to a plurality of rail members 2 aligning parallel to each other, so as to be arranged at equally spaced intervals along the rail members 2 and also at equally spaced intervals along the direction in which the rail members 2 align with each other.

In the arrangement example of FIG. 13, the X-ray radiation units 3 aligning along the rail members 2 are connected to each other through the relay cables 25, so as to construct a plurality of unit rows A. The X-ray radiation units 3 at end parts of the unit rows A are connected to each other through the relay cables 25 so as to connect all the unit rows A into a single line.

In the arrangement example of FIG. 14, the X-ray radiation units 3 on one end side of a plurality of unit rows A are connected to each other through the relay cables 25. Thus, the plurality of unit rows A are connected so as to branch off from each other. The X-ray radiation unit 3 on one end side of the unit row A is connected to the X-ray radiation unit 3 adjacent thereto along the rail member 2 and also to the X-ray radiation unit 3 adjacent thereto along the direction in which the rail members 2 align with each other and thus has two output terminals 8.

Figure 15:
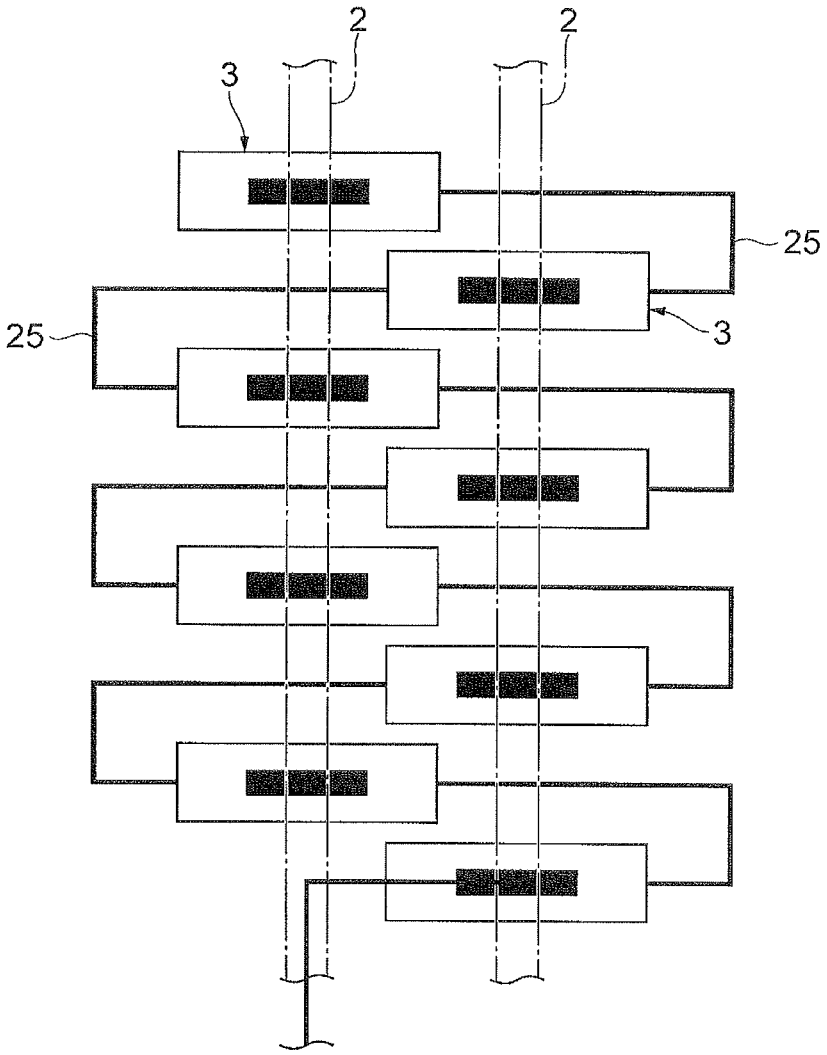
FIG. 15 is a diagram illustrating a further example of arrangement of X-ray radiation units.

FIG. 15 illustrates an example in which a plurality of X-ray radiation units 3 are distributively attached to a plurality of rail members 2 aligning parallel to each other, so as to form a zigzag pattern. In this arrangement example, all the X-ray radiation units 3 are connected through the relay cables 25 into a single line along the zigzag pattern.

Figure 16:
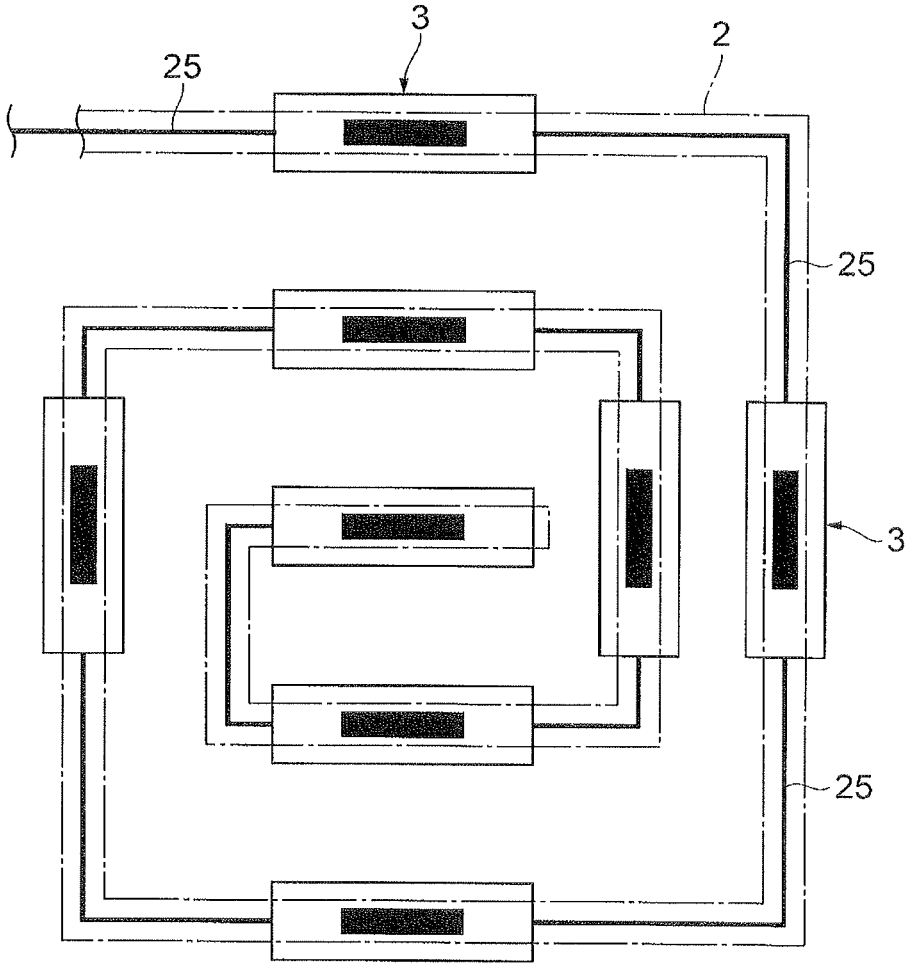
FIG. 16 is a diagram illustrating a furthermore example of arrangement of X-ray radiation units.

FIG. 16 illustrates an example in which the rail member 2 bends spirally, while a plurality of X-ray radiation units 3 are arranged spirally along the rail member 2. All the X-ray radiation units 3 are connected into a single line through the relay cables 25.

While a preferred embodiment of the present invention is explained in the foregoing, the present invention is not limited to the above-mentioned embodiments but can be modified in various ways within the scope not deviating from the gist of the invention. For example, the X-ray radiation device 1 may comprise a plurality of controllers 4, while a plurality of X-ray radiation units 3 may be connected to each controller 4. The output terminal 8 or I/O terminal 24 and the input terminal 7 may directly be connected to each other without the relay cable 25.

The output terminal 8 or I/O terminal 24 and the input terminal 7 may directly be connected to each other without the relay cable 25, while the power, control signal, life notification signal, and the like may be transferred through wireless means between the adjacent X-ray radiation units 3 and controllers 4. The trunk line 22 may omit the control signal line 22*b* and life notification signal line 22*c* and transmit the control signal and life notification signal through wireless means, while leaving the power lines 22*a*.

Though the supplied power is not feedback-controlled in this embodiment, for example, while monitoring the target current, a grid voltage (drive voltage) which is a voltage applied to the grid 18 serving as a drive voltage may be feedback-controlled so as to keep the target current constant. In this case, the life is determined according to the grid voltage, and the life notification signal is outputted when the grid voltage is at a threshold or higher.

Both of the drive current and drive voltage may be used for determination, and the life notification signal may be outputted when the life of any of them is detected. For each of the drive current and drive voltage, the life may be determined when not falling within a predetermined range (e.g., from 70% to 130%) set with respect to two thresholds of greater and smaller points, i.e., rated values, instead of the relationship in magnitude with a single threshold.

REFERENCE SIGNS LIST

1: X-ray radiation device; 2: rail; 3: X-ray radiation unit (X-ray radiation source); 4: controller; 5: housing; 6: X-ray tube; 7: input terminal; 8: output terminal; 9: light-emitting device; 10: joint member; 15: drive circuit; 15*a*: drive control circuit; 15*b*: life detection circuit; 15*c*: display circuit; 22: trunk line; 22*a*: power line; 22*b*: control signal line; 22*c*: life notification signal line; 23: control circuit; 23*a*: power circuit; 23*b*: control signal transmission circuit; 23*c*: life notification signal receiving circuit; 25: relay cable; 27: comparator circuit; 28: capacitor; M1: X-ray emission surface; M2: back face; M3, M4: side face

The invention claimed is:

1. An X-ray radiation device comprising:

a plurality of X-ray radiation sources, each having an X-ray tube for generating an X-ray, a drive circuit for driving the X-ray tube, and a trunk line connected to the drive circuit; and a controller having a control circuit for controlling the X-ray radiation sources;

wherein the trunk lines of the plurality of X-ray radiation sources are connected in series to the control circuit so that the drive circuits of the plurality of X-ray radiation sources are connected in parallel to the control circuit, wherein the X-ray radiation source further comprises input and output terminals serving as external connection ports for the trunk line, and wherein the output terminal of one such X-ray radiation source is detachably connected to the input terminal of another such X-ray radiation source through a relay cable, the X-ray radiation device further comprising a rail for attaching thereto the plurality of X-ray radiation sources in a row;

wherein the X-ray radiation source further comprises a housing for containing the X-ray tube, drive circuit, trunk line, input terminal, and output terminal;

wherein the housing has on the outside thereof an X-ray emission surface for emitting the X-ray generated by the X-ray tube, a back face opposing the X-ray emission surface, and a pair of side faces intersecting the X-ray emission surface while opposing each other; and wherein each of the X-ray radiation sources is attached to the rail such that the back face opposes the rail while the opposing direction of the pair of side faces lies along the extending direction of the rail.

2. An X-ray radiation device according to claim 1, wherein the rail and housing are made of a metal material;

wherein the housing is attached to the rail through a joint member detachably attached to the rail; and wherein the joint member is made of an insulating material.

3. An X-ray radiation device according to claim 2, further comprising the joint member for holding the relay cable near the rail.

4. An X-ray radiation device comprising:

a plurality of X-ray radiation sources, each having an X-ray tube for generating an X-ray, a drive circuit for driving the X-ray tube, and a trunk line connected to the drive circuit; and a controller having a control circuit for controlling the X-ray radiation sources;

wherein the trunk lines of the plurality of X-ray radiation sources are connected in series to the control circuit so that the drive circuits of the plurality of X-ray radiation sources are connected in parallel to the control circuit, wherein the control circuit has a power circuit for supplying power to the drive circuit, a control signal transmission circuit for transmitting a control signal for driving and stopping the X-ray tubes, and a life notification signal receiving circuit for receiving a life notification signal concerning a life of the X-ray tubes;

wherein the trunk line has a power line for transmitting power to the drive circuits, a control signal line for transmitting the control signal, and a life notification signal line for transmitting the life notification signal; and wherein the drive circuit has a drive control circuit for receiving the control signal from the control signal line and controlling the driving and stopping of the X-ray tubes, and a life detection circuit for detecting the life of the X-ray tubes and transmitting the life notification signal to the life notification signal line.

5. An X-ray radiation device according to claim 4, wherein the life detection circuit has a comparator circuit for comparing a drive current value of the X-ray tubes with a preset threshold and detects the life of the X-ray tubes according to a result of comparison in the comparator circuit.

6. An X-ray radiation device according to claim 4, wherein the life detection circuit has a comparator circuit for comparing a drive voltage value of the X-ray tubes with a preset threshold and detects the life of the X-ray tubes according to a result of comparison in the comparator circuit.

7. An X-ray radiation device according to claim 4, wherein the drive circuit further comprises a display circuit for externally displaying the transmission of the life notification signal.

8. An X-ray radiation device according to claim 7, wherein the display circuit has a light-emitting device for emitting light according to the life notification signal and a capacitor connected in parallel to the light-emitting device.

9. An X-ray radiation source comprising:

an X-ray tube for generating an X-ray;

a drive circuit for driving the X-ray tube;

a trunk line connected to the drive circuit; and input and output terminals serving as external connection ports for the trunk line;

wherein a voltage value inputted from the input terminal is equal to that outputted from the output terminal, wherein the trunk line has a power line for transmitting power to the drive circuit, a control signal line for transmitting a control signal for driving and stopping the X-ray tube, and a life notification signal line for transmitting a life notification signal concerning a life of the X-ray tube; and wherein the drive circuit has a drive control circuit for receiving the control signal from the control signal line and controlling the driving and stopping of the X-ray tube, and a life detection circuit for detecting the life of the X-ray tube and transmitting the life notification signal to the life notification signal line.

10. An X-ray radiation source according to claim 9, further comprising a housing for containing the X-ray tube, drive circuit, trunk line, input terminal, and output terminal;

wherein the housing has on the outside thereof an X-ray emission surface for emitting the X-ray generated by the X-ray tube, a back face opposing the X-ray emission surface, and a pair of side faces intersecting the X-ray emission surface while opposing each other; and wherein the input and output terminals are arranged so as to open respectively at the pair of side faces.

11. An X-ray radiation source according to claim 9, wherein the life detection circuit has a comparator circuit for comparing a drive current value of the X-ray tube with a preset threshold and detects the life of the X-ray tube according to a result of comparison in the comparator circuit.

12. An X-ray radiation source according to claim 9, wherein the life detection circuit has a comparator circuit for comparing a drive voltage value of the X-ray tube with a preset threshold and detects the life of the X-ray tube according to a result of comparison in the comparator circuit.

13. An X-ray radiation source according to claim 9, wherein the drive circuit further comprises a display circuit for externally displaying the transmission of the life notification signal.

14. An X-ray radiation source according to claim 13, wherein the display circuit has a light-emitting device for emitting light according to the life notification signal and a capacitor connected in parallel to the light-emitting device.

* * * * *